US006648378B1

(12) United States Patent
Torres et al.

(10) Patent No.: US 6,648,378 B1
(45) Date of Patent: Nov. 18, 2003

(54) AUTOMATIC KNOT-TYING DEVICE

(75) Inventors: Michael Torres, Seattle, WA (US); George E. Riehm, New Fairfield, CT (US)

(73) Assignee: Via Science LLC, Newcastle, WA (US)

( * ) Notice: Subject to any disclaimer, the term of this patent is extended or adjusted under 35 U.S.C. 154(b) by 0 days.

(21) Appl. No.: 10/264,545

(22) Filed: Oct. 4, 2002

(51) Int. Cl.[7] ..... B65H 69/04

(52) U.S. Cl. ..... 289/1.5; 289/1.2; 289/17; 289/18.1

(58) Field of Search ..... 289/1.2, 1.5, 2, 289/17, 18.1; 140/93 B, 93 R, 93.2, 93.4, 93.6, 101

(56) References Cited

U.S. PATENT DOCUMENTS 3,057,648 A 10/1962 Schwarze et al.
3,252,723 A * 5/1966 Burke ..... 289/1.5
3,821,058 A * 6/1974 Miller ..... 156/468
4,094,342 A 6/1978 Nishikawa et al.
4,502,905 A 3/1985 Jung et al.
4,534,817 A * 8/1985 O'Sullivan ..... 156/352
4,558,894 A 12/1985 Detterbeck et al.
5,505,504 A * 4/1996 Sato et al. ..... 289/2
6,279,970 B1 8/2001 Torres
6,457,492 B1 * 10/2002 Kuhn et al. ..... 140/123.6

* cited by examiner

*Primary Examiner*—Gary L. Welch
(74) *Attorney, Agent, or Firm*—Polly L. Oliver

(57) ABSTRACT

An automatic knot-tying device for tying a discrete knot about a workpiece, such as a bundle of wires, has been developed. The present invention works by pulling a filament, such as the FAA-approved lace, transversely around the workpiece. The preferred embodiment of the device comprises a hand-held housing and a knot-tying mechanism within that housing comprising a plurality of carriage rings, for wrapping the filament around the workpiece, at least one shuttle for moving the filament between the carriage rings and along the workpiece at the appropriate steps, and a plurality of hooks for pulling the filament away from the workpiece at the appropriate steps. The operation is finished by cinching, cutting, and reloading so that the resulting knot is discrete and secure. A method for automatically tying a knot around a workpiece uses the present invention to pull, instead of push, a filament around the workpiece.

20 Claims, 12 Drawing Sheets

AUTOMATIC KNOT-TYING DEVICE

FIELD OF THE INVENTION

This invention relates generally to automatic knot-tying devices and more particularly to an automatic knot-tying device for tying a knot around a generally cylindrical target item.

BACKGROUND OF THE FIELD

In many industries, both military and commercial, such as the aircraft, automotive, and appliance industries, wire bundles, or harnesses, are used extensively in the manufacturing processes of various products. Each bundle, or harness, generally comprises two or more wires that customarily are tied together at various points along their lengths to help ensure safety and durability, as well as a generally clean design.

Individually tying the bundle points by hand is costly, labor-intensive, and time-consuming, and often leads to carpal tunnel syndrome, or other physical injury, in the operator. With these problems in mind, several patented inventions have been directed toward automating the wire-tying process. One such device, that described in German Offenlegungsschrift No. 2,533,640 and improved in U.S. Pat. No. 4,558,894 to Detterbeck et al, is a hand-held pistol-like apparatus that forms a continuous crocheted tying structure around and along a bundle of wires. Even Detterbeck's improvement, however, does not actually tie a knot around the bundle: it simply pulls taut a predetermined number of loops. The device, therefore, is limited because it is not capable of tying individual knots at discrete points along the bundle.

Another patented device is described in U.S. Pat. No. 4,094,342 to Nishikawa et al. Nishikawa's device uses guide channels along the inside surface of the bundle holding elements to guide the string or cord around the wire bundle into the shape of a knot. The string is then pulled taut and cut. Several problems, including jamming and inconsistent knot quality, are associated with the Nishikawa device because it pushes, rather than pulls, the string around the bundle.

One feature of knot-tying is that a second pass of the string around the bundle must be laid in front of or behind a first pass. The prior art has not dealt with this problem very successfully; instead, many prior art devices have tried simply to lay the string in patterns described by guide channels in the holding elements themselves. The Nishikawa device, and other devices, particularly the one described in U.S. Pat. No. 3,057,648 to Schwarze et al, use guide channels of differing depths to result in criss-crossing passes of the string. In a different approach, the device disclosed in prior art patent to Jung et al., U.S. Pat. No. 4,502,905, uses a transverse pin with a hook to grab the second pass of the string and draw it back across the first pass.

The device in U.S. Pat. No. 6,279,970 to Torres improves upon the other prior art devices by using a system comprising a nozzle and various reciprocating pins and hooks which move the string or other filament into and out of the knot-tying area. The Torres device pulls, rather than pushes, a string, cord or other filament (such as the FAA-approved "lace") around the workpiece, such string issuing from the nozzle, while the pins and hooks manipulate the string into the knot configuration. However, the Torres device is quite complex, having 25–30 motions involving rings, pins, and hooks, which must be precisely coordinated and indexed in order to accomplish the knot.

The Jung device illustrates another problem in the prior art—that of finishing the knot. After the string is laid around the bundle, the Jung device heats and bonds the string instead of tying a knot. Such heating, or other type of fusing or bonding, as well as the use of plastic, generic cotton string, or other fabric are frequently not acceptable because of the harsh environments encountered by many installations of wire bundles. Depending upon the particular industry and the application of the product, these bundles may be placed in environments of extreme temperature, vibration, radiation, or other types of shock. To withstand these conditions while maintaining the integrity of the knot, many applications require the use of "lace," a particular type of flexible string-like material.

SUMMARY OF THE INVENTION

The present invention is an improvement upon the device in Torres U.S. Pat. No. 6,279,970, because the present invention uses fewer moving parts and requires fewer steps to accomplish the tied knot. The present invention also improves upon the complexity of the Torres device by eliminating many coordinated motions. Further, it has the capability of tying many different types of knots, including the knot specified by aircraft manufacturers.

One aspect of the present invention comprises a compact, lightweight, hand-held housing with an activating button or switch (the device can be powered either electrically or pneumatically) so that a user can easily manipulate the device and apply a knot at any desired discrete location, or a series of discrete locations, along a wire bundle or other target item, that may be of circular, oval, rectangular, or other regular or irregular geometric cross-section. In this preferred embodiment, the housing defines a generally U-shaped opening into which the bundle fits with the bundle's longitudinal axis orienting generally transverse to the housing's handle, and to the reference plane defined by the U-shaped opening. The user does not have to manipulate the bundle or come into physical contact with it at all; he or she simply thrusts the device around the bundle and presses the button.

The housing contains a knot-tying mechanism that ties an actual knot, i.e., not loops or chains of loops, around the wire bundle, by pulling the tying filament (i.e., any flexible, generally cylindrical length of tying material), not pushing it as most prior art devices do. With the present invention, any of several different knots could be tied, with different arrangements and indexing of rings, shuttles, and hooks; however, in the preferred embodiment, it has been chosen to tie a clove hitch around the wire bundle and then tie a surgeon's knot to secure the clove hitch, because this combination of clove hitch and surgeon's knot is the FAA-approved method of tying wire harnesses. Military aircraft manufacturers also require use of the clove hitch/surgeon's knot combination.

Further, the FAA (Federal Aviation Administration) and military specifications also often call for the use of "lace," a particularly durable type of braided filament. Although it can use a variety of filaments, the preferred embodiment of the present invention has been designed to use "lace," and the remaining discussion will use that term.

The preferred embodiment of the knot-tying mechanism operates in three distinct stages. In the first stage, the mechanism wraps and tightens the clove hitch around the bundle, and then in the second stage, the mechanism ties the surgeon's knot to secure the clove hitch. In the third stage, the mechanism, after cinching and cutting the knot, resets itself for the next knot-tying operation. A continuous supply of lace, or other filament, is fed to the device by a belt-mounted or housing-mounted spool, or some other method.

The entire knot-tying process from the moment the device engages the bundle to the moment the device disengages the bundle, leaving a precisely tied, tight, and finished discrete knot, takes approximately 5 seconds, using the preferred embodiment. Of course, alternate embodiments, particularly with alternate controlling means, can easily modify the processing time, e.g., for other types of knots.

The knot-tying mechanism of the preferred embodiment comprises three C-shaped carriage rings for wrapping the lace (hence sometimes referred to as "wrapping rings") generally transversely around the wire bundle or other workpiece; a single shuttle, which shuttles between the rings (along an axis parallel to that of the workpiece), carrying the lead end of the lace with it, thereby laying the lace over or under the previous passes; and two hooks, which pull the lace away from the knot-tying area and form loops with the lace at appropriate times.

The preferred embodiment also comprises two clamps, one on either side of the knot-tying mechanism, for centering and stabilizing the workpiece within the working area of the mechanism. In the preferred embodiment, which is a hand-held embodiment of the invention, the clamps are sized to accommodate a generally cylindrical workpiece (e.g., bundle of wires) having a size range from ⅛" to 1⅛" diameter. When the user first engages the preferred embodiment of the device with the bundle, by placing the opening of the housing generally transversely around the bundle, the clamps are activated. At this point, the knot-tying mechanism is in the initial set-up position. In this initial set-up position, the lead end of the lace issuing from the supply spool has been fed through a guide attached to one of the rings into the interior working area, defined by the C-shaped rings, and is being held in place by a clamp on the shuttle. Once actuated, by the button or other actuation method, the mechanism begins the clove hitch process. With the lace being continuously available from the supply spool through the guide, the carriage rings rotate around the bundle, carrying the shuttle and the lace with them. As the rings rotate around the workpiece, stopping at predetermined index positions, the shuttle carries the lead end of the lace back and forth between the rings. The two hooks, which are referred to in the preferred embodiment as the up hook and the down hook and are oriented in opposite directions away from the workpiece, come into play at various times to snag the lace. When the hooks have snagged the lace and are extended away from the workpiece—in their respective opposite directions—a loop is formed in the lace. The cooperation and indexing of the rings, the shuttle, and the hooks result in the chosen knot being properly laid and tied around the workpiece.

Once the clove hitch is complete and tight, the knot-tying mechanism then ties and finishes a surgeon's knot to secure the clove hitch and then finishes the procedure. In this surgeon's-knot tying process, the same three carriage rings, shuttle, up hook, and down hook are used as were used in the clove hitch tying process.

In the preferred embodiment, once the surgeon's knot is complete, the lace knot is tightened and a cutting edge severs the lace so that the knot is stand-alone and discrete. The subsequent lead end of the lace is then reattached to the clamp on the shuttle, and the mechanism is ready for the next application.

DETAILED DESCRIPTION OF THE PREFERRED EMBODIMENT

Figure 1A:
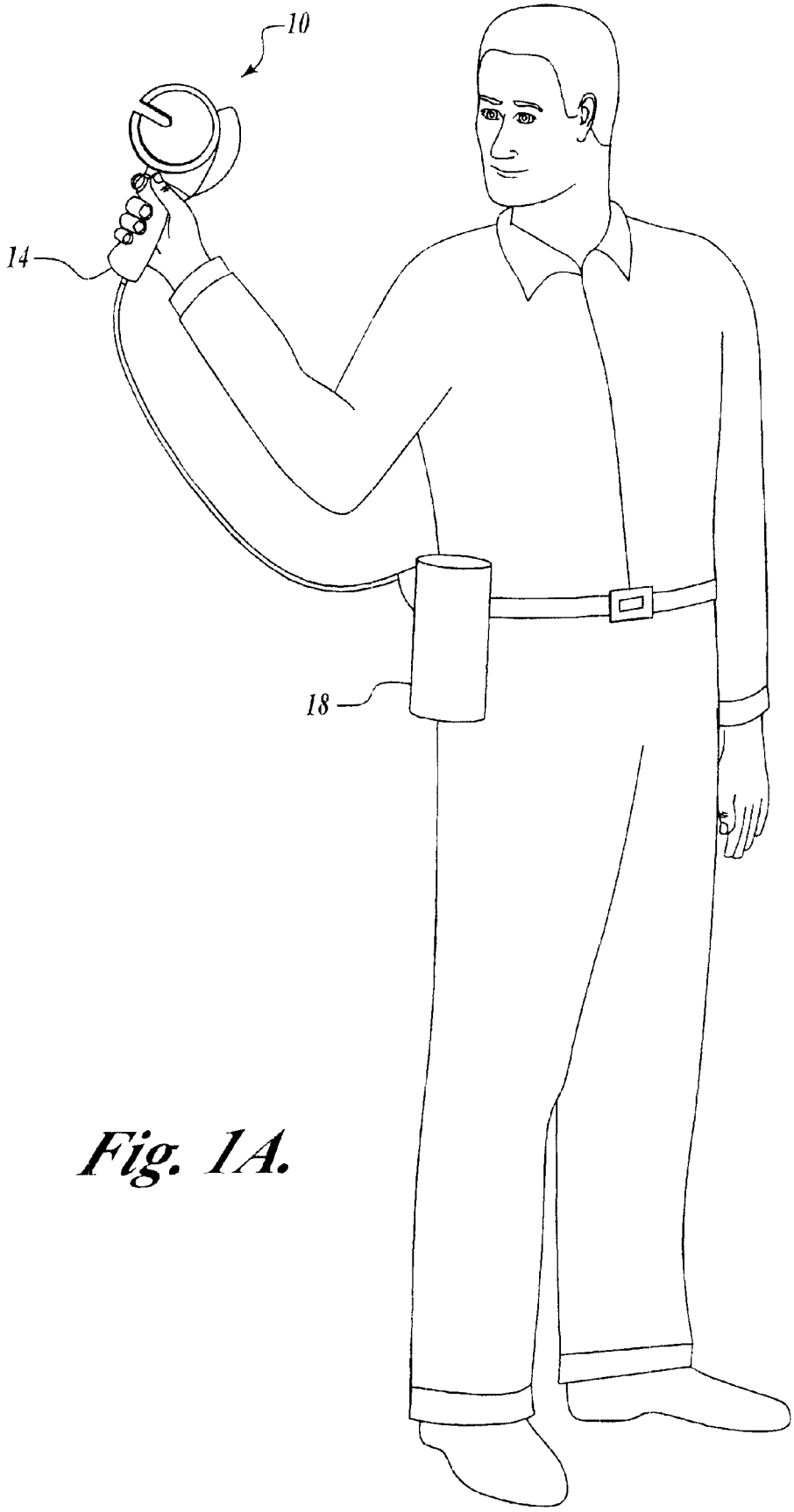
FIG. 1A is a front view of the preferred embodiment of the invention of the automatic knot-tying device as it is held by a user.
Figure 1B:
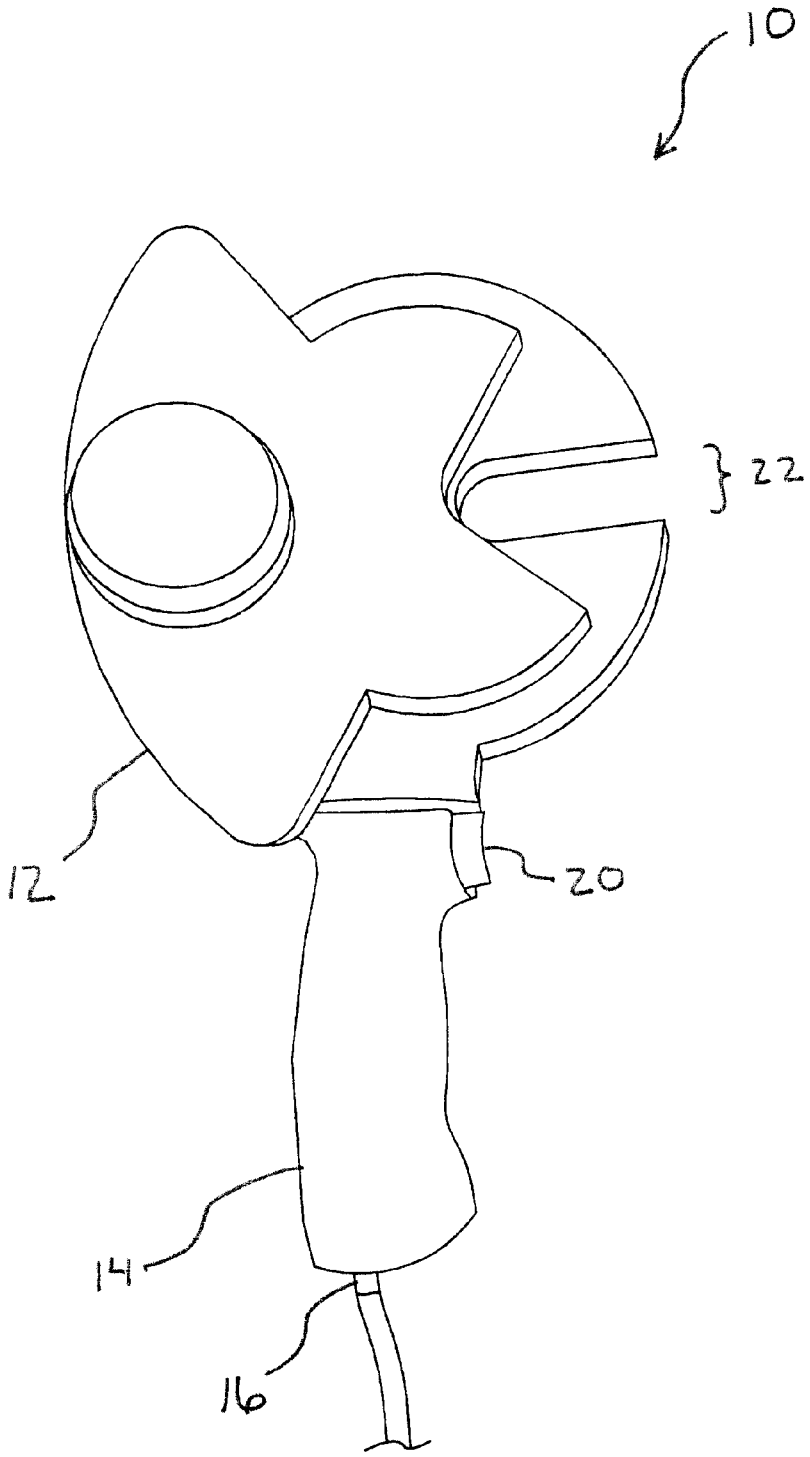
FIG. 1B is a back view of the preferred embodiment of the invention of the automatic knot-tying device.

FIG. 1A is a perspective view of the preferred embodiment of the invention of the improved automatic knot-tying device 10 as it is intended to be held by a user. The lace supply 18 in the preferred embodiment is a belt-mounted spool. In alternate embodiments, the lace supply could be a spool or reel mounted to the handle 14 or other location on or within the housing, or the supply used could be appropriate to a different kind of filament. FIG. 1B is a perspective back view of the preferred embodiment of the invention of the improved automatic knot-tying device 10. The device 10 comprises a housing 12 attached to a handle 14 with power connection 16. The preferred embodiment also comprises a trigger 20 for actuating the device. However, in alternate embodiments, there could be a button, proximity sensor, or other device mounted on the housing for purposes of actuation.

Figure 3:
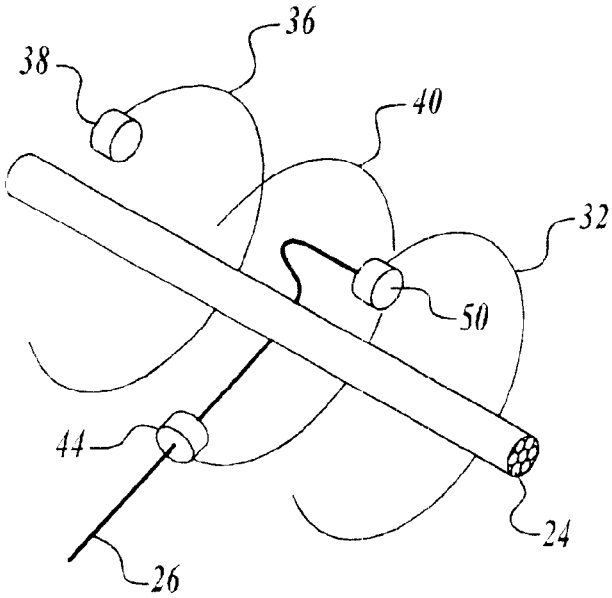
FIG. 3 is a schematic view showing the initial step in the clove hitch process.
Figure 4:
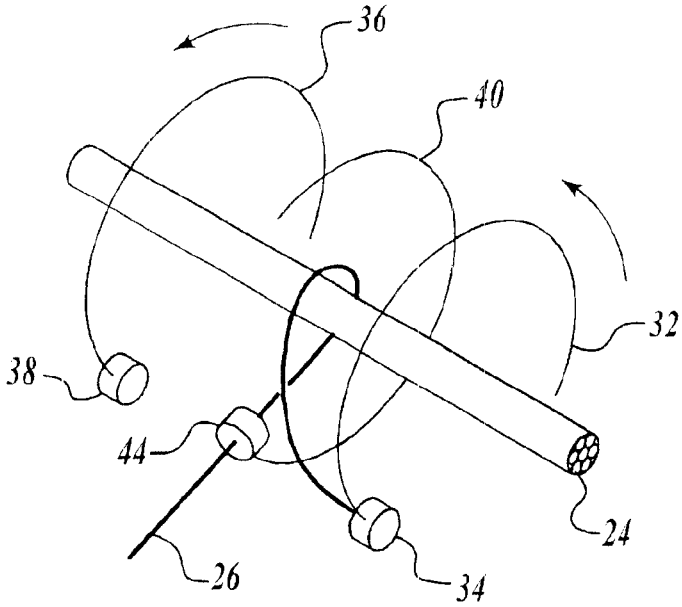
FIG. 4 is a schematic view showing an intermediate step in the clove hitch process.

In the preferred embodiment of FIG. 1B, the housing 12 defines a generally U-shaped opening 22 for accommodating the workpiece, usually a bundle of wires 24 (best shown in FIGS. 3 and 4). The opening 22 defines the reference plane and fits around the bundle 24 such that the handle 14 of the device 10 and the reference plane are generally orthogonal to the longitudinal axis of the bundle 24.

Figure 2A:
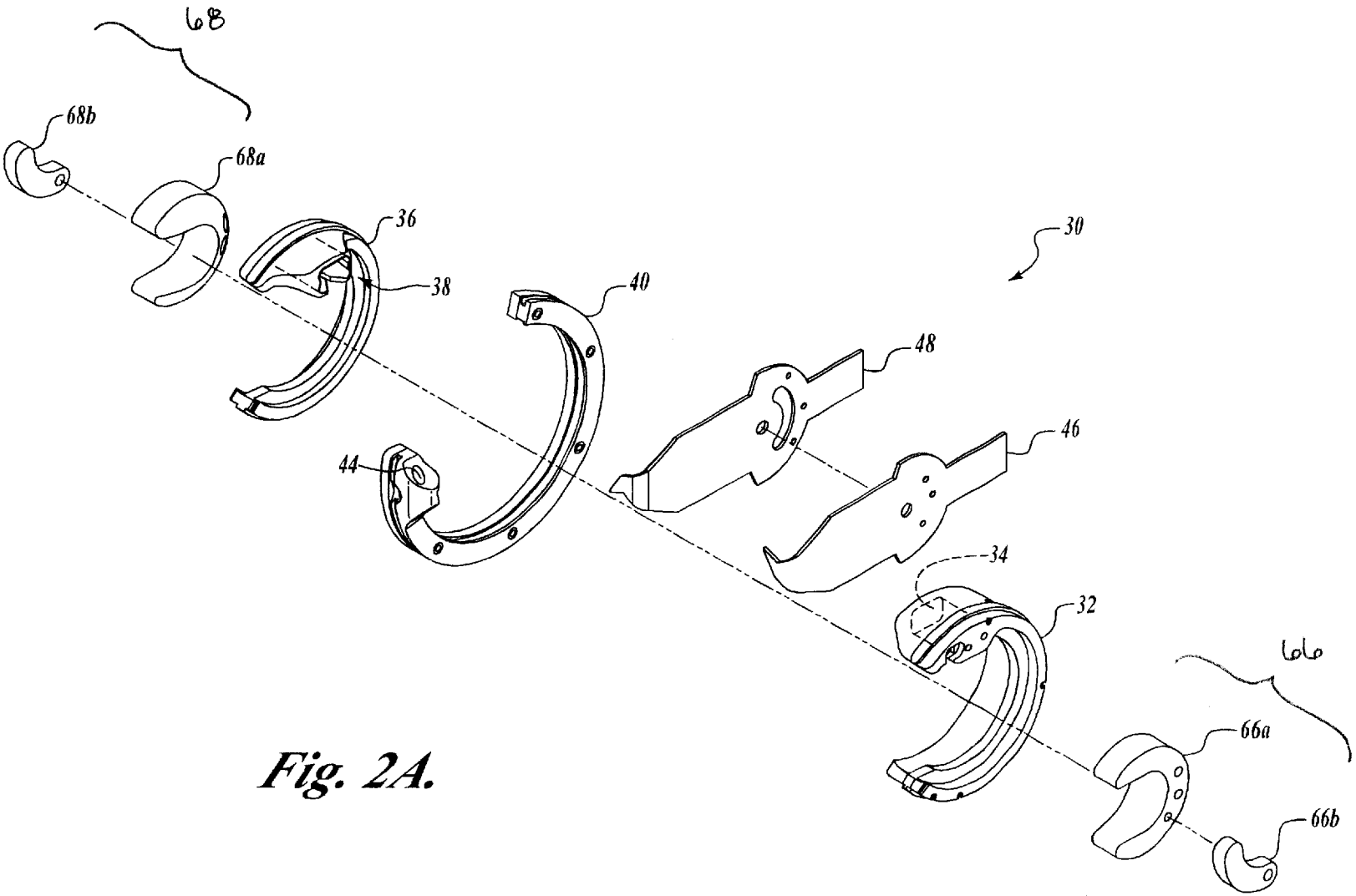
FIG. 2A is an exploded view showing the components of the knot-tying mechanism of the preferred embodiment.

The knot-tying mechanism 30 is shown in FIG. 2A in exploded view showing the three generally C-shaped carriage rings of the preferred embodiment: the right carriage ring 32, the left carriage ring 36, and the lace ring 40, which has an inner diameter slightly larger than that of the other carriage rings. Also shown are the two hooks: the up hook 46 and the down hook 48. In the preferred embodiment, both hooks 46, 48 are located adjacent each other between the right carriage ring 32 and the lace ring 40, but could of course be differently located, as could the rings, in different mechanism configurations. The rings and the hooks may be pivotally mounted as necessary on a base plate (not shown) which is fixed to the interior of the housing 12 or directly to the interior of the housing itself. Finally, in this figure, two centering clamps 66 (including 66*a* and 66*b*) and 68 (including 68*a* and 68*b*) are shown on either side of the mechanism 30.

Figure 2B:
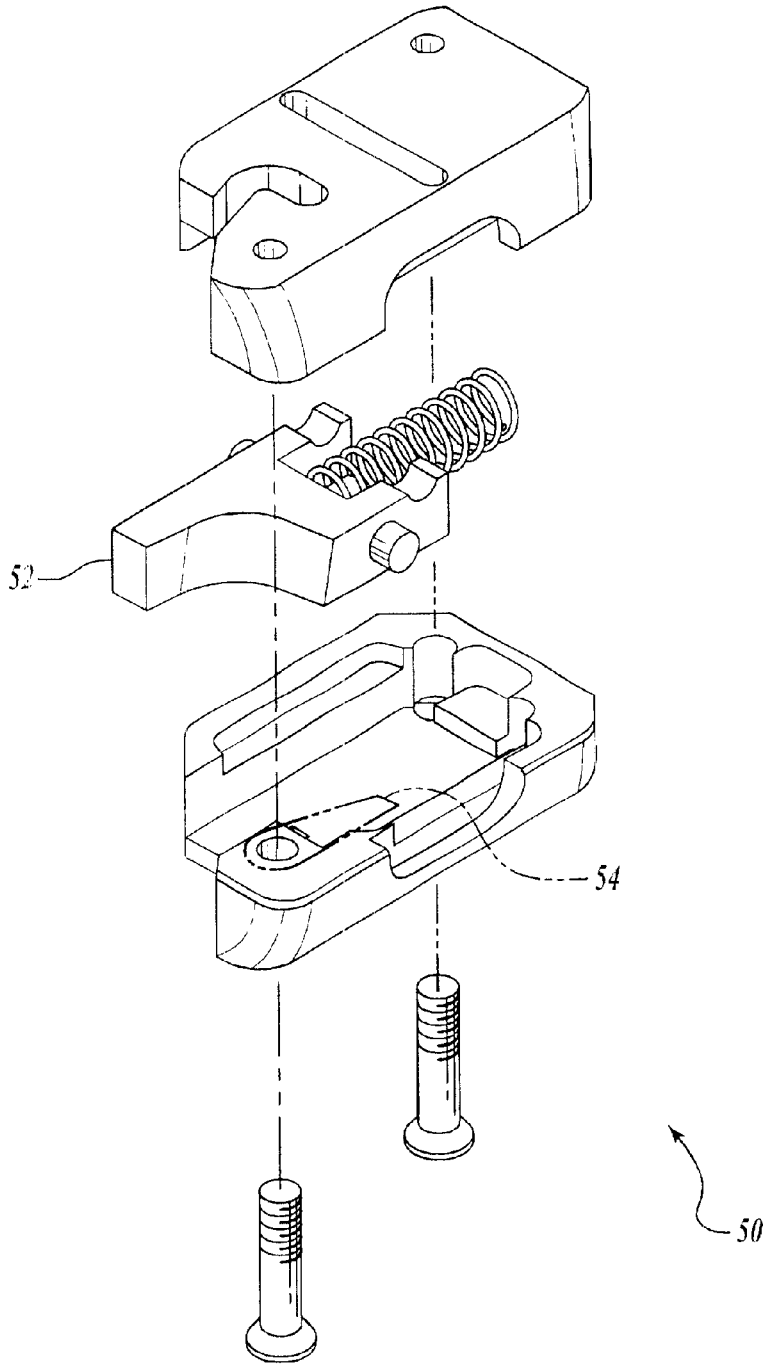
FIG. 2B is a detail view of the shuttle of the preferred embodiment.

In the preferred embodiment, the shuttle 50 (shown in detail in FIG. 2B) travels between the two carriage rings 32, 36 along the path prescribed by the respective shuttle receptacles 34 and 38 and comprises both a shuttle clamp 52, for holding the lead end of the lace 26 (seen in the next FIGS. 3 and 4), and the cutting blade 54, which is to be used in the final stage of finishing the knot.

Referring again to FIG. 2A, the mechanism 30 fits into the housing 12 such that in the initial set-up position, the opening defined by the C-shaped carriage rings aligns with the U-shaped opening 22 of the housing 12. The workpiece 24, usually a wire bundle, fits into the opening 22 such that it is entirely within the circular working plane defined by the rings 32, 36, and 40. The lace 26, or other filament, is delivered from the lace supply 18 through the guide 44 on the lace ring 40 to the clamp 52 on the shuttle 50. There may also be additional lace guides on or within the housing itself depending upon the particular housing design.

Figure 5:
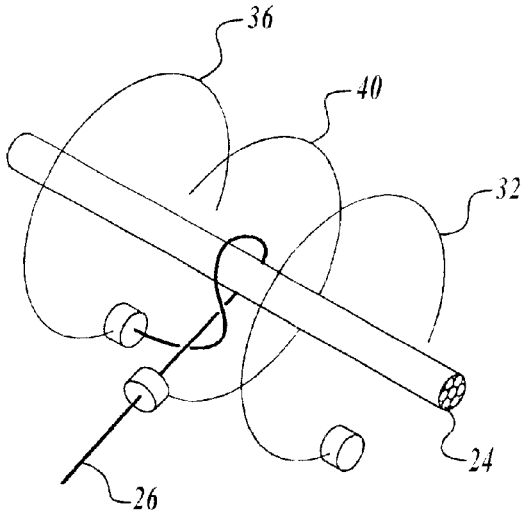
FIG. 5 is a schematic view showing an intermediate step in the clove hitch process.

The following figures are a series of schematic views showing the operation of the knot-tying mechanism. The views are given in generally the same perspective as the foregoing figures. FIG. 3 depicts the initial set-up position of the mechanism 30 and shows that when the wire bundle 24 is initially loaded into the opening 22 of the mechanism 30, the lace 26 has already been pulled from the lace supply 18, led through the bobbin lace guide 44 on the lace ring 40, and securely fastened to the shuttle clamp 52 within the shuttle 50, which is resting in the shuttle receptacle in the right carriage ring 32. When the wire bundle 24 is inserted, the lace 26 deforms by pulling through the bobbin guide 44. In the next step, the two carriage rings 32, 36 are rotated in the direction of the arrows in FIG. 4 (i.e., counterclockwise), which shows the resulting configuration of the lace 26 around the bundle 24. In the next step, and shown in FIG. 5, the shuttle 50 is transferred to the left shuttle receptacle 38 in the left carriage ring 36 such that the shuttle 50 passes under the lace 26 issuing through the bobbin guide 44.

Figure 6:
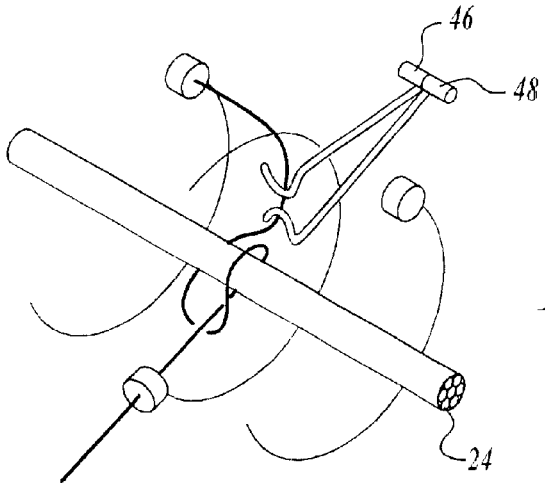
FIG. 6 is a schematic view showing an intermediate step in the clove hitch process.
Figure 7:
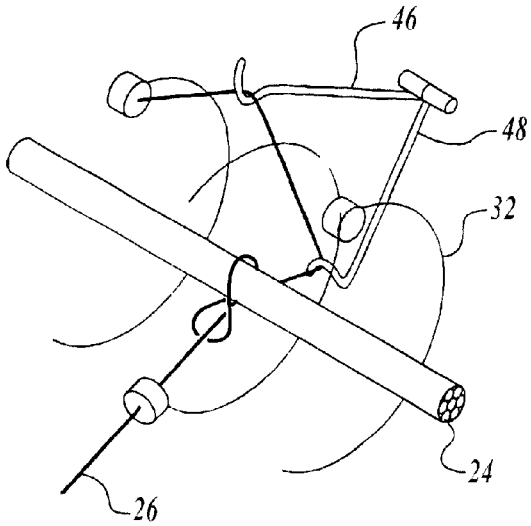
FIG. 7 is a schematic view showing an intermediate step in the clove hitch process.
Figure 8:
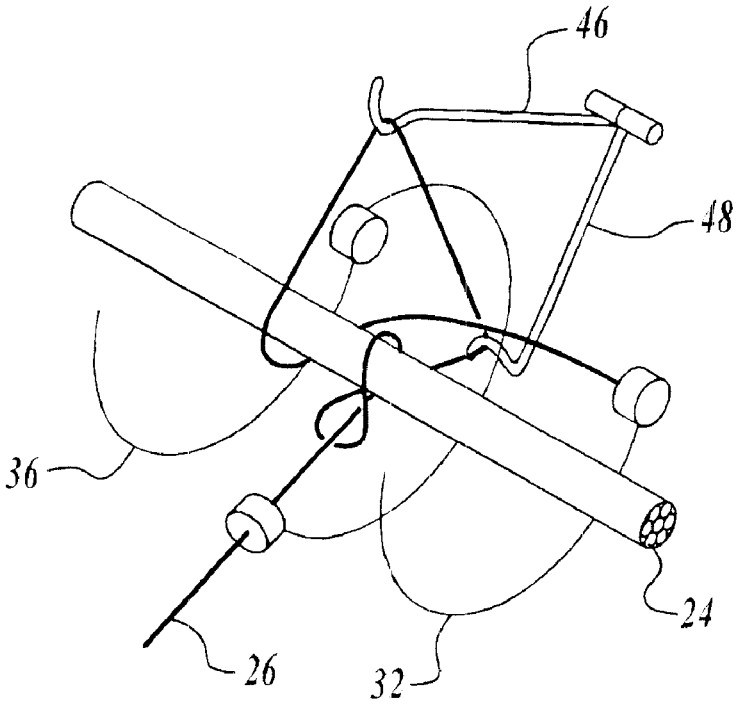
FIG. 8 is a schematic view showing an intermediate step in the clove hitch process.

Next, the carriage rings 32, 36 continue to rotate in the counterclockwise direction, engaging the lace 26 from the shuttle 50 with the hooks 46, 48, as shown in FIG. 6. FIG. 7 shows how the hooks spread apart, i.e., up hook 46 moves up and down hook 48 moves down, to form a loop in the lace 26 as the carriage rings 32, 36 continue to rotate counterclockwise. FIG. 8 shows that when the carriage rings 32, 36 complete the current rotation, the shuttle 50 is positioned for a pass through the loop, such pass being depicted in FIG. 8.

Figure 9:
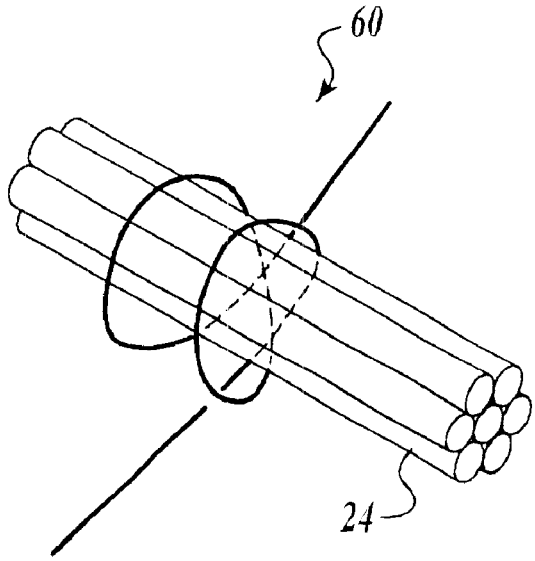
FIG. 9 is a perspective schematic view of the clove hitch.
Figure 10:
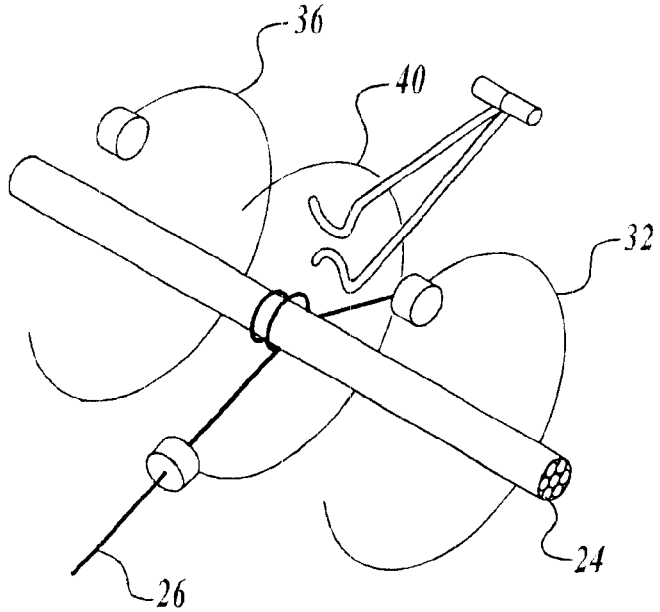
FIG. 10 is a schematic view showing the initial set-up in the surgeon's knot process.

The hooks 46, 48 now collapse, releasing the loop, and the lace is cinched with tension from the bobbin lace tensioner 42. (Such tensioner 42 may be co-located with the bobbin lace guide 44, but in the preferred embodiment is mounted separately on the base plate or the housing as shown in the side view of FIG. 15.) The resulting clove hitch 60 around the wire bundle 24 is shown in perspective view in FIG. 9. The mechanism 30 is now positioned to begin the surgeon's knot process, as shown in FIG. 10.

Figure 11:
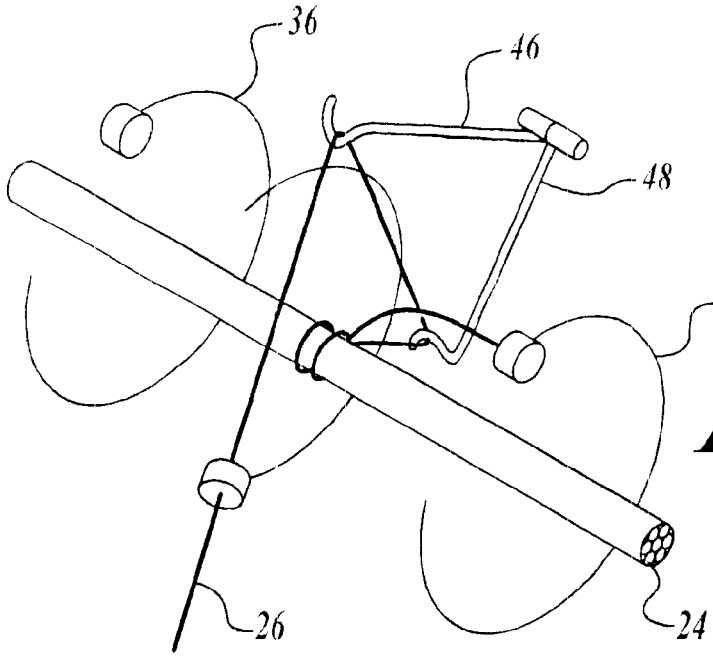
FIG. 11 is a schematic view showing an intermediate step in the surgeon's knot process.
Figure 12A:
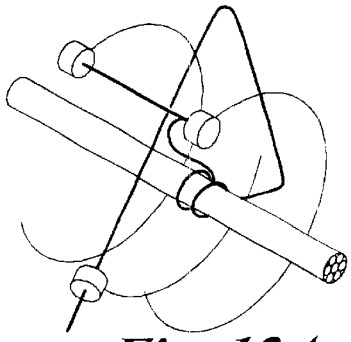
FIGS. 12A–E are schematic views showing intermediate steps in a subprocess of the surgeon's knot process.
Figure 12B:
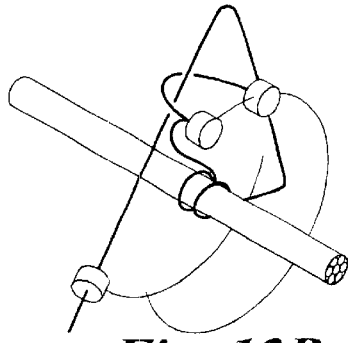
Figure 12C:
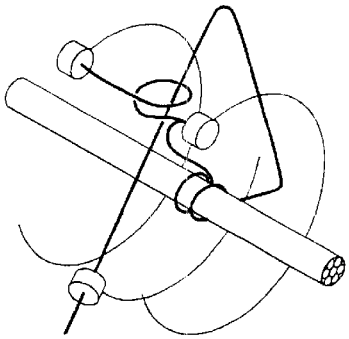
Figure 12D:
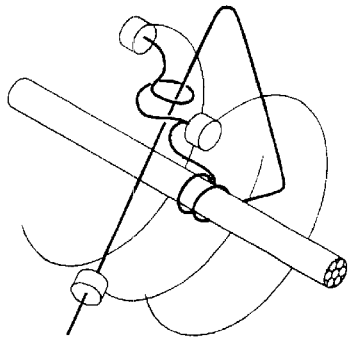
Figure 12E:
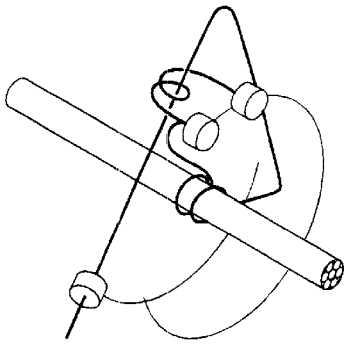

The surgeon's knot process is begun by rotating the lace ring 40 approximately 360 degrees counterclockwise, thereby engaging the bobbin end of the lace 26 with the hooks 46, 48. The hooks 46, 48 are once again spread apart, so as to hold the lace 26 temporarily spaced away from the bundle 24, as shown in FIG. 11. The shuttle 50 is resting in the right carriage ring 32, and the carriage rings 32, 36 are next rotated alternatingly clockwise and counterclockwise, while the shuttle 50 is transferred between them. FIGS. 12A–D are detail views which show intermediate steps in this subprocess, and FIG. 12E shows the resulting configuration of the lace 26 wrapped around itself.

Figure 13:
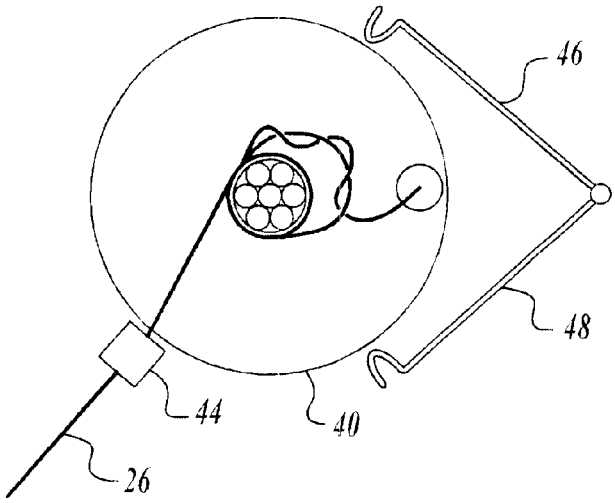
FIG. 13 is a side schematic view showing an intermediate step in the surgeon's knot process.
Figure 14:
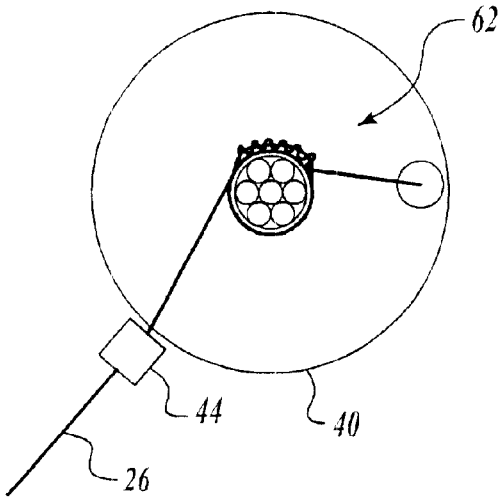
FIG. 14 is a side schematic view showing the final step in the surgeon's knot process.

FIG. 13 shows the configuration of the lace 26 around the bundle 24 after the hooks 46, 48 have been released, and FIG. 14 shows the knot 62 tightened around the bundle 24 (by cinching the lace 26 from the lace tensioner 42).

Figure 15:
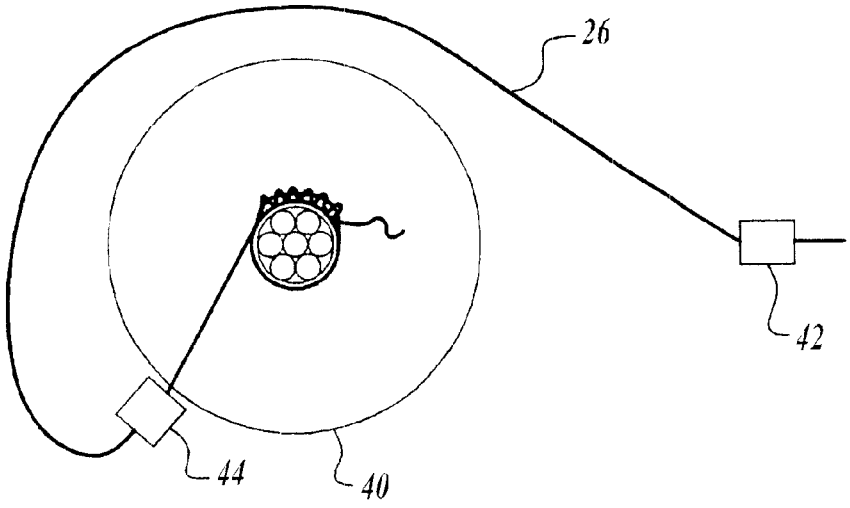
FIG. 15 is a side schematic view showing an intermediate step in the cutting and reloading process.
Figure 16:
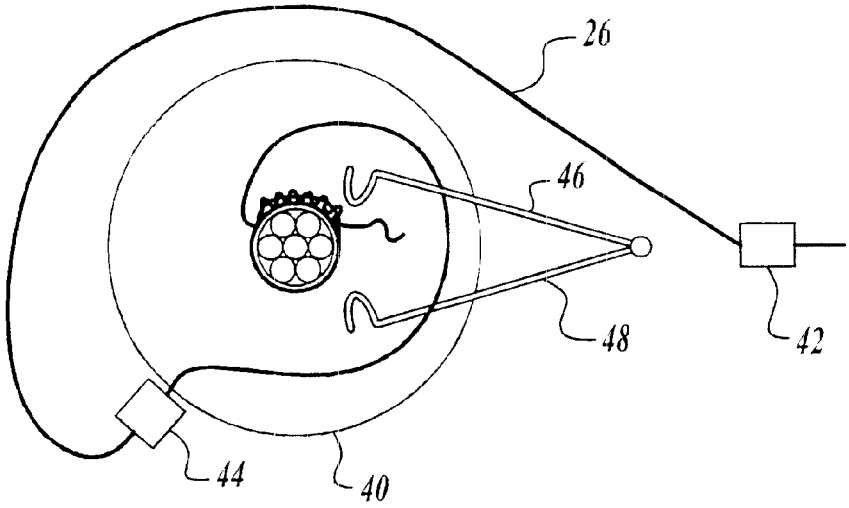
FIG. 16 is a side schematic view showing an intermediate step in the cutting and reloading process.

The following figures are schematic views showing the third stage (i.e., cutting and reloading) of the knot-tying mechanism. For clarity, the views are side views, instead of the perspective of the foregoing figures. Once the knot 62 has been tied and secured around the wire bundle 24, the lace 26 is released from the shuttle clamp 52, as shown in FIG. 15, and the lace ring 40 rotates clockwise approximately 360 degrees, carrying the bobbin guide 44 with it and engaging the lace 26 with the hooks 46, 48, as shown in FIG. 16.

Figure 17:
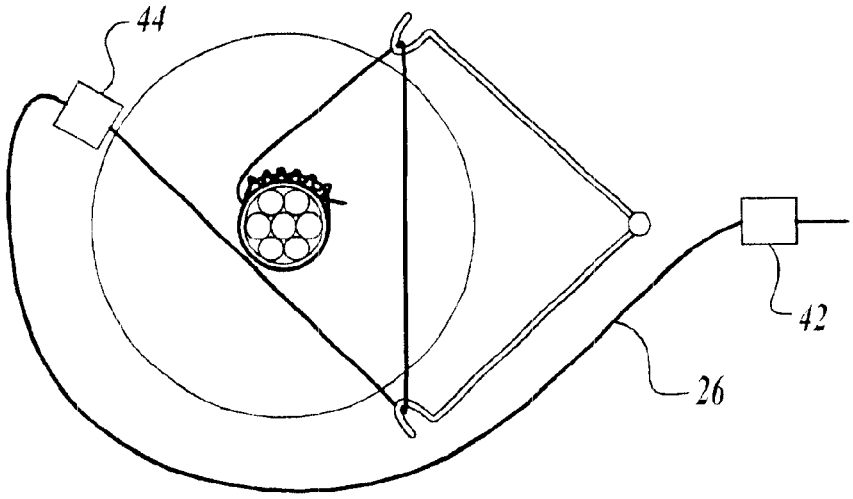
FIG. 17 is a side schematic view showing an intermediate step in the cutting and reloading process.
Figure 18:
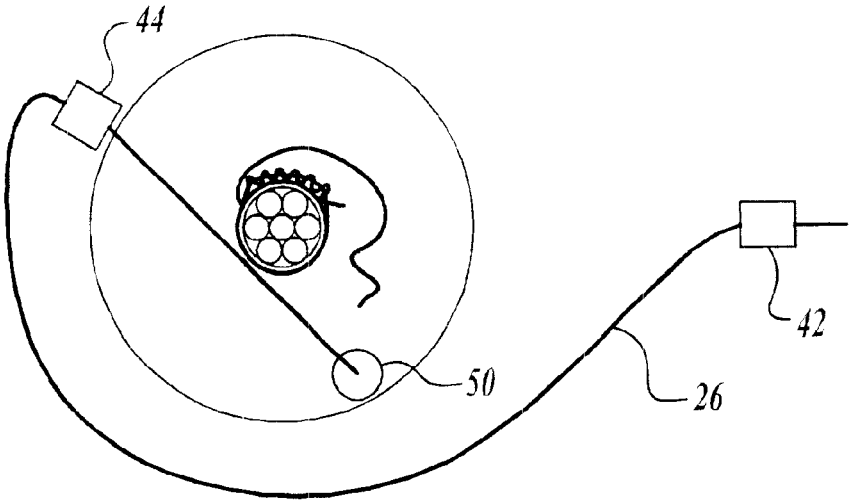
FIG. 18 is a side schematic view showing the final step in the cutting and reloading process.

The hooks 46, 48 are now spread apart, as in FIG. 17, and the carriage rings 32, 36 (not shown in this side view) are rotated so that the shuttle 50 is positioned to recapture the lace 26 in preparation for the set-up for the next application of the mechanism 30. As the hooks release the lace 26, and as the shuttle passes from one ring to the other, the shuttle 50 recaptures the lace 26, which is cinched by the lace tensioner 42, and the cutting blade 54 within the shuttle 50 (shown in FIG. 2B) severs the lace to the knot 62, as shown in FIG. 18. The mechanism is now set up for the next application.

In an alternate embodiment, the cutting blade 54 is mounted within a recess in one of the carriage rings 32, 36 instead of within the shuttle 50. In this alternate embodiment, once the mechanism reaches a stage corresponding to FIG. 17, the cutting blade 54 would extend from the ring 32 or 36 as necessary to encounter and sever the lace 26 as the lace is recaptured by the shuttle 50. The cutting blade would then retract into its recess within the carriage ring in preparation for the next application.

What is claimed is:

1. An apparatus for tying a flexible filament into a discrete knot around a workpiece, having a longitudinal axis, comprising:

a housing, said housing defining an opening for the workpiece and an interior working area within the opening, a supply of flexible filament linked to the housing such that the filament is threaded into the interior working area of the housing, a mechanism mounted within the interior working area of the housing, comprising a plurality of generally arcurate wrapping elements mounted to the housing such that the wrapping elements are capable of circumscribing the workpiece by rotating around the interior working area, at least one of said wrapping elements defining a shuttle receptacle, a plurality of hooks mounted to the housing, said hooks extending into the proximity of the workpiece and being capable of being spaced away from the workpiece, and at least one shuttle slidably mounted within the shuttle receptacle of at least one of the wrapping elements, said shuttle also including a cutting blade and a clamp for clamping the lead end of the filament, and a power source connection attached to the housing and linked to the mechanism within the housing.

2. The apparatus of claim 1 wherein the housing is of sufficient size and weight to be hand-held.

3. The apparatus of claim 1 wherein the opening in the housing is generally U-shaped.

4. The apparatus of claim 1 wherein the housing further comprises at least one clamp for holding the workpiece steady throughout the knot-tying operation.

5. The apparatus of claim 4 wherein the clamp is capable of securing workpieces of the size range ⅛" to 1 ⅛" diameter.

6. The apparatus of claim 1, wherein the power source connection is adapted to accept a power source chosen from the group of electric, pneumatic, and hydraulic power sources.

7. The apparatus of claim 1 wherein the housing further comprises a handle with a trigger for actuating the mechanism.

8. The apparatus of claim 1, wherein the supply of filament is mounted outside the housing.

9. The apparatus of claim 1, wherein the filament is chosen from the group of string, cord, and FAA-approved lace.

10. A mechanism for tying a flexible filament into a discrete knot around a workpiece, having a longitudinal axis, comprising:

a housing, said housing defining a reference plane generally orthogonal to the longitudinal axis of the workpiece, a plurality of wrapping elements-mounted to the housing, each element being capable of circumscribing the workpiece in a plane generally coplanar with the reference plane by rotating around the workpiece, at least one of said wrapping elements defining a shuttle receptacle, and a plurality of hooks mounted to the housing, said hooks extending into the proximity of the workpiece and being capable of being spaced away from the workpiece generally in a plane generally coplanar with the reference plane, and at least one shuttle slidably mounted within the shuttle receptacle of at least one of the wrapping elements, said shuttle also including a clamp for clamping the lead end of the filament.

11. The mechanism of claim 10 wherein each wrapping element comprises a ring swingably mounted to the housing, each ring being capable of circumscribing the workpiece in a plane generally coplaner with the reference plane.

12. The mechanism of claim 11, wherein each wrapping ring comprises a generally C-shaped member, each member defining a generally arcurate opening allowing insertion of the workpiece.

13. The mechanism of claim 12, wherein at least one of the wrapping rings further comprises a filament guide mounted to the C-shaped member for channeling the filament into the proximity of the workpiece.

14. The mechanism of claim 13, wherein there are three generally concentric and axially-spaced wrapping rings, including a middle ring and two outer rings, the middle ring having a slightly larger diameter than the outer rings, and the middle ring being the one with the filament guide.

15. The mechanism of claim 14, wherein the two outer rings define correspondingly inward-facing shuttle receptacles on their inner surfaces and the shuttle is capable of translating from one receptacle to the other while clamping the lead end of the filament.

16. The mechanism of claim 15 wherein the shuttle further comprises a cutting blade, such blade being capable of extending into the path of the filament or retracting completely into the shuttle.

17. The mechanism of claim 12, wherein at least one of the wrapping rings further defines a recess and a cutting blade extendably mounted therein.

18. The mechanism of claim 10 wherein the hooks are pivotally mounted to the housing, such that the hooks can alternately extend into the proximity of the workpiece and be spaced away from the workpiece generally in a plane generally coplanar with the reference plane.

19. A method for automatically tying a flexible filament into a discrete knot by pulling the filament and thereby defining a filament path about a generally cylindrical workpiece having a longitudinal axis, using a device comprising a plurality of generally arcurate wrapping rings capable of circumscribing the workpiece, one such ring having a filament guide attached thereon for channeling the filament into the proximity of the workpiece, a shuttle slidably mounted to at least one of the wrapping rings, said shuttle comprising a cutting blade and a filament clamp, and a plurality of hooks, capable of extending into and out of said path of the filament in the proximity of the workpiece, such method comprising the steps of:

positioning the wrapping rings around the workpiece, pulling the flexible filament through the filament guide and clamping it to the filament clamp of the shuttle, pulling the flexible filament generally transversely around the workpiece, while contemporaneously circumscribing the workpiece with the wrapping rings while the shuttle travels between the rings carrying the filament, contemporaneously extending the hooks into and out of the path of the pulled filament so as to interlace the flexible filament to form a knot, and subsequently cinching and securing the knot about the workpiece.

20. The method of claim 19, further comprising the steps of:

after the knot has been secured, cutting the filament issuing from the filament guide with the cutting blade, thereby leaving a discrete, finished knot secured about the workpiece; and automatically retrieving the filament issuing from the guide and relocating it so as to set up the device for the next application.

* * * * *